US007210976B2

(12) United States Patent
Gordon

(10) Patent No.: US 7,210,976 B2
(45) Date of Patent: May 1, 2007

(54) INFLATABLE RAFT WITH INFLATABLE CLIMBING SLIDE

(75) Inventor: Donald W. Gordon, Draper, UT (US)

(73) Assignee: Aviva Sports, L.L.C., Montreal, MO (US)

( * ) Notice: Subject to any disclaimer, the term of this patent is extended or adjusted under 35 U.S.C. 154(b) by 1367 days.

(21) Appl. No.: 10/012,763

(22) Filed: Nov. 3, 2001

(65) Prior Publication Data

US 2002/0055309 A1 May 9, 2002

Related U.S. Application Data

(60) Provisional application No. 60/246,151, filed on Nov. 3, 2000.

(51) Int. Cl.
*B63C 9/08* (2006.01)

(52) U.S. Cl. ..... 441/129; 472/117

(58) Field of Classification Search ..... 472/117, 472/116, 128; 441/136, 129, 125
See application file for complete search history.

(56) References Cited

U.S. PATENT DOCUMENTS

| | | | | | |
|---|---|---|---|---|---|
| 3,679,025 | A | * | 7/1972 | Rummel | 182/20 |
| 4,693,691 | A | * | 9/1987 | DeYoe | 441/129 |
| D327,198 | S | | 6/1992 | Erker, Jr. et al. | |
| 5,409,411 | A | | 4/1995 | Schrieber | |
| D375,989 | S | | 11/1996 | Jacobs | |
| 5,678,357 | A | | 10/1997 | Rubio et al. | |
| D407,259 | S | | 3/1999 | Jackson | |
| 6,406,377 | B1 | * | 6/2002 | Demko | 472/116 |

* cited by examiner

*Primary Examiner*—Jesus D. Sotelo
(74) *Attorney, Agent, or Firm*—Mallinckrodt & Mallinckrodt; Robert R. Mallinckrodt

(57) ABSTRACT

An inflatable play structure includes an inflatable platform and an inflatable slide attached to the platform. The platform provides stability to the slide when the structure is used in water so that it does not easily turn over. Further, the slide is preferably positioned on the platform so that the platform provides a resting and staging area for the slide. When used on land, the slide may be positioned so the platform provides a cushioned area for a user to land when coming down the slide.

15 Claims, 4 Drawing Sheets

INFLATABLE RAFT WITH INFLATABLE CLIMBING SLIDE

RELATED APPLICATION

This application claims the benefit of my copending U.S. Provisional Application Serial No. 60/246,151 filed Nov. 3, 2000.

BACKGROUND OF THE INVENTION

1. Field

The invention is in the field of inflatable play structures for use in water or on land.

2. State of the Art

In recent years inflatable structures or inflatables, especially water toys and lounges or mats that people lay on while in the water have become very popular. With their increased popularity in recent years, more sophisticated inflators and valves have been developed which has opened up opportunities for even larger inflatable designs. Nearly all such inflatables on the market are used passively, i.e., a user lies on, sits on, or rides on them. There are very few inflatables which are interactive with the user thereof. Interactive inflatables on the market include small, inflatable slides such as those which fit within or otherwise interface with small children's wading pools. Such inflatable slides are not useable in adult pools or lakes, either at the edge thereof or actually in the water.

SUMMARY OF THE INVENTION

According to the invention, an inflatable slide, which includes a substantially vertical end and a sloped surface extending from the top of the vertical end downwardly toward the opposite end of the slide, is secured to an inflatable platform which forms a stabilizing base for the inflatable slide. The platform provides a standing area to start ascent of or use of the slide when the structure is used in water or a cushioned landing area for users of the slide when the structure is used on land. The position of attachment of the inflatable slide to the inflatable platform may be changed for water or land use.

The inflatable platform, which serves as a raft in the water, with the inflatable slide thereon makes it possible to not only have a slide that can be safely used around the perimeter of an adult pool, but in the pool, on the water, off a dock, or in a lake. Additionally, it can also be used on the grass, indoors at home, or in a daycare or preschool environment.

THE DRAWINGS

Figure 1:
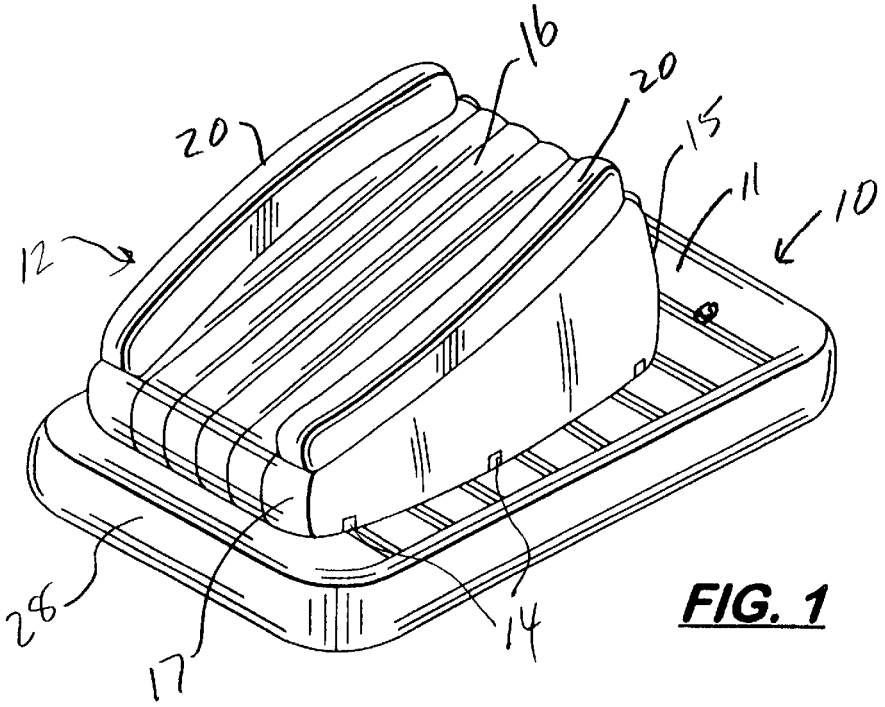
Figure 2:
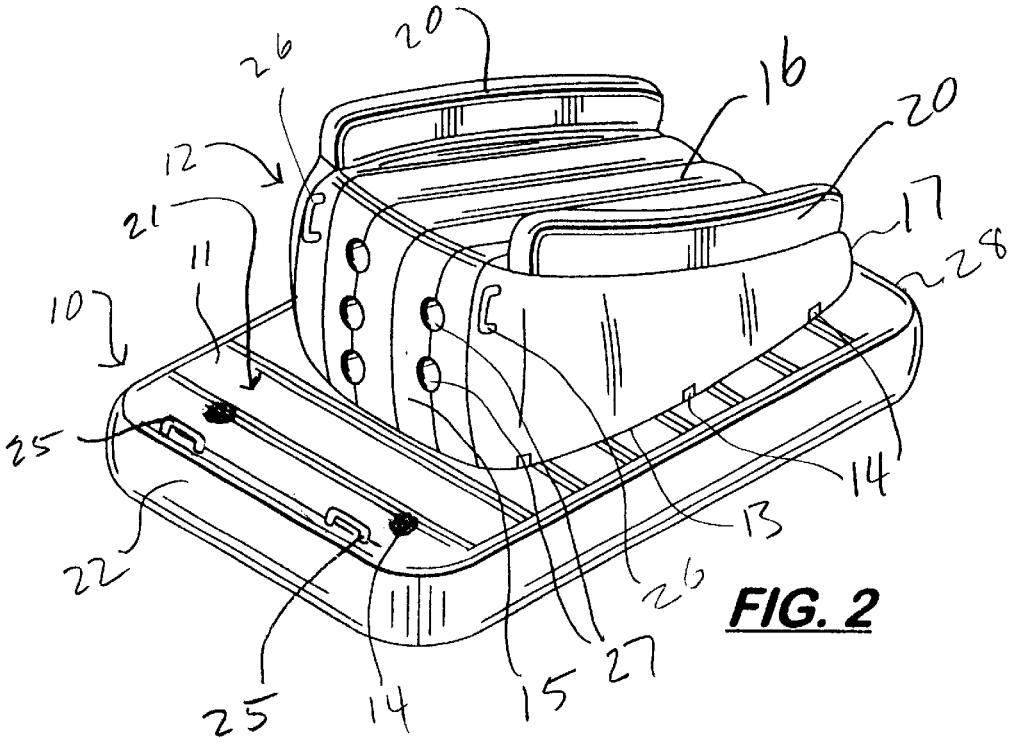
Figure 3:
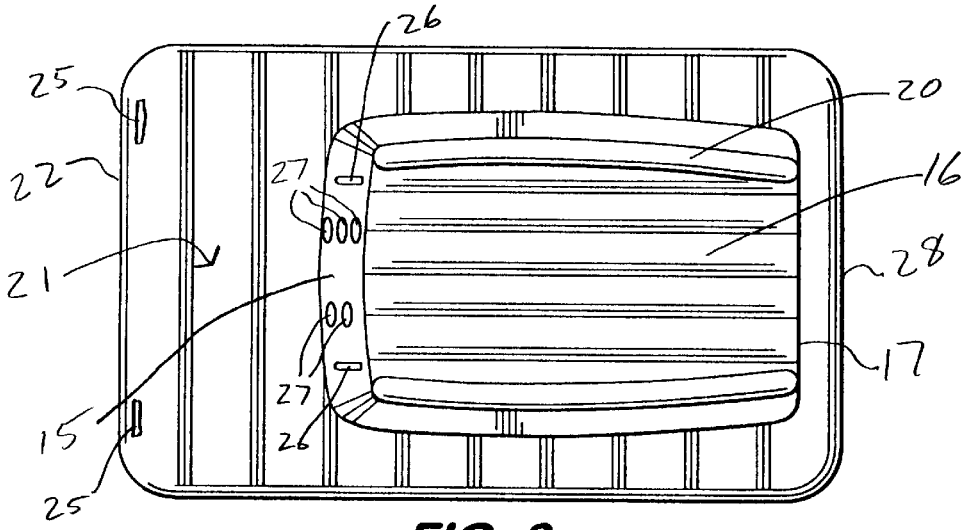
Figure 4:
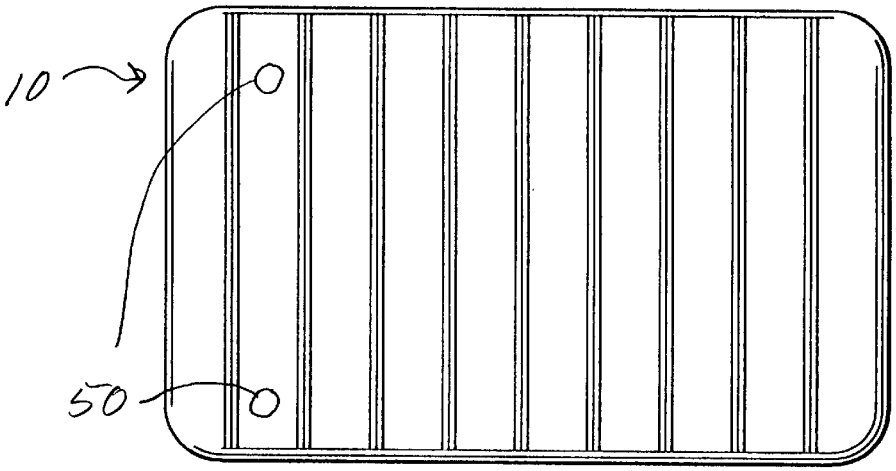
Figure 5:
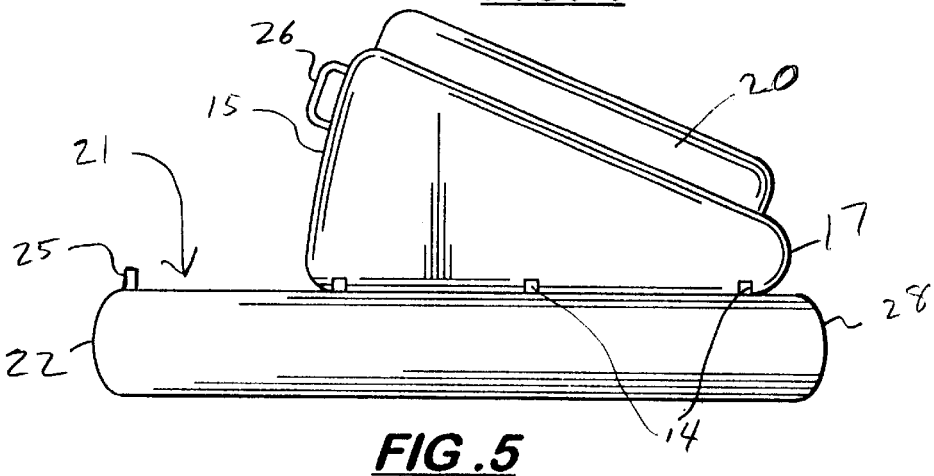
Figure 6:
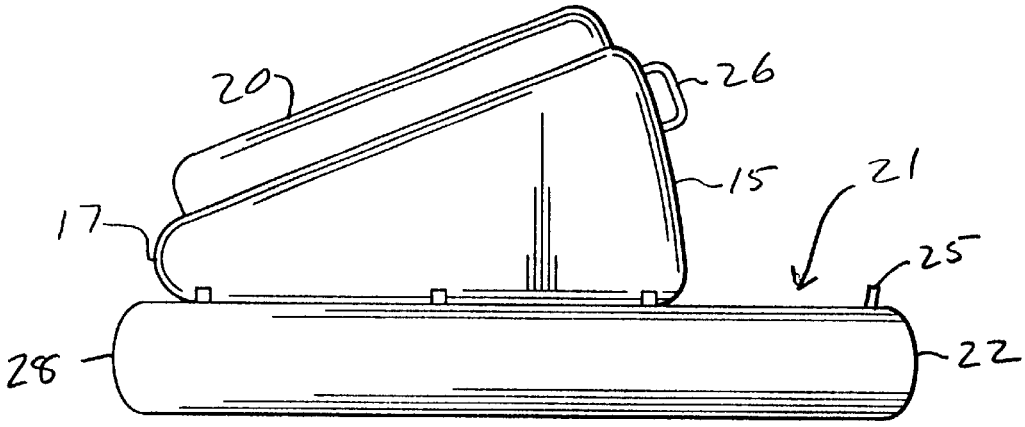
Figure 7:
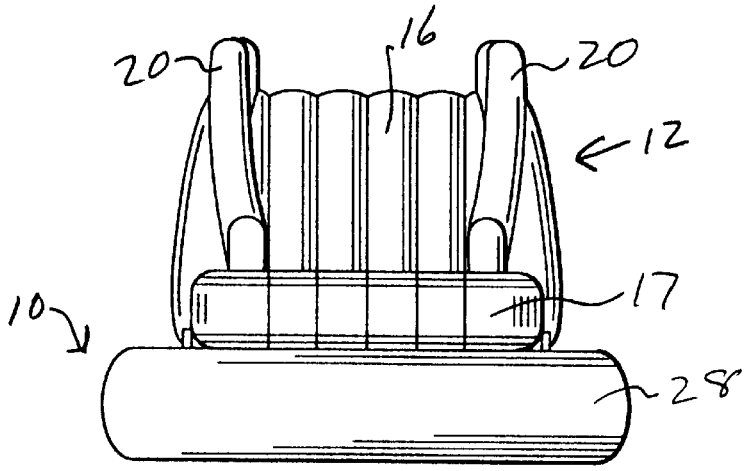
Figure 8:
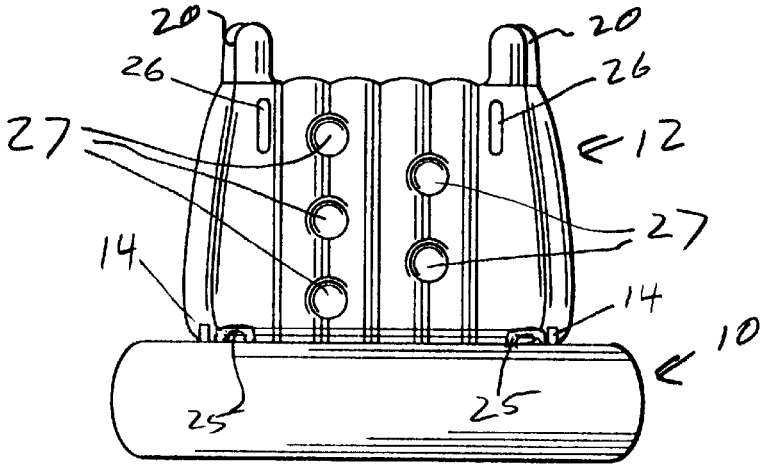
Figure 9:
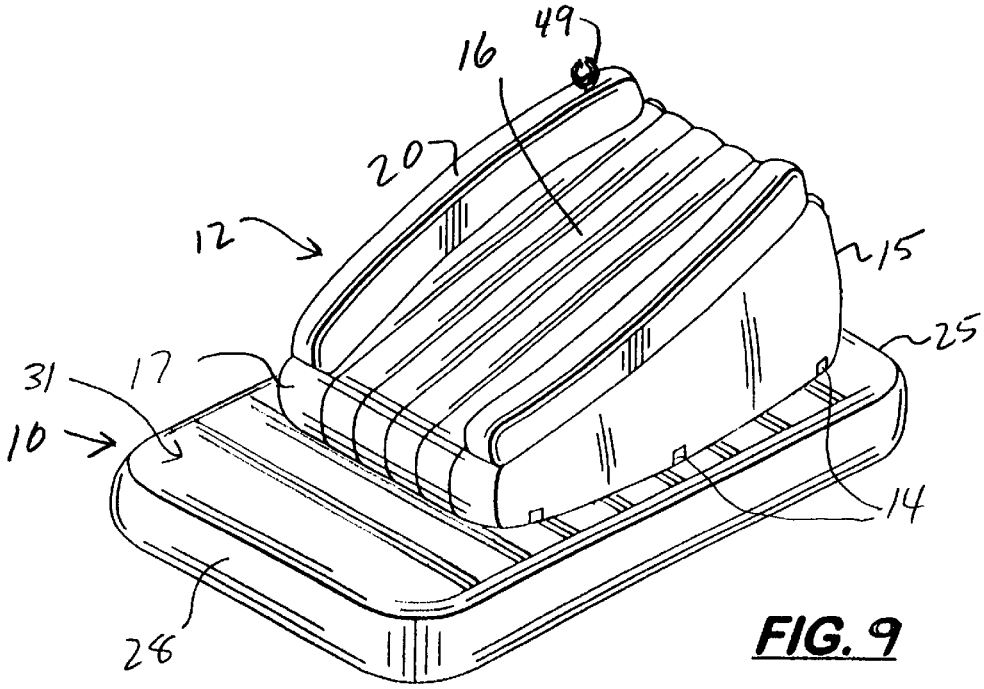
Figure 10:
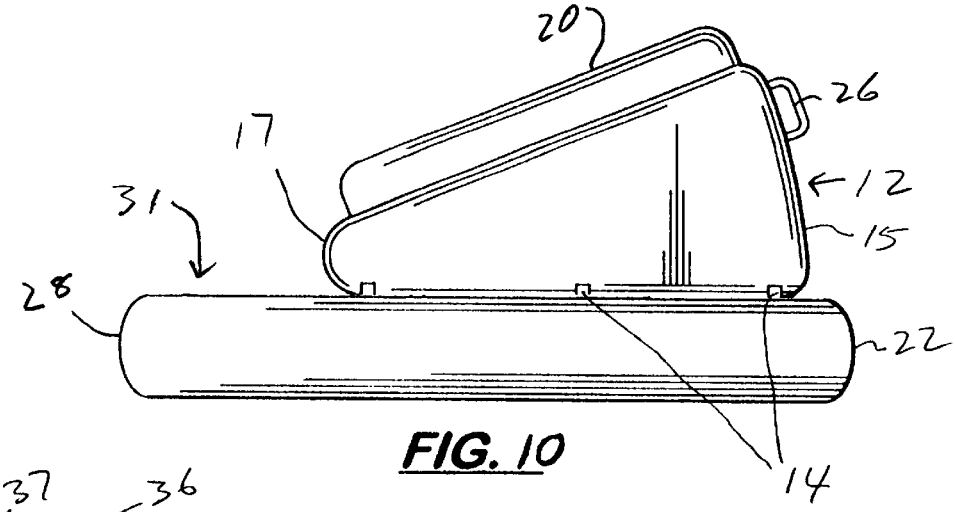
Figure 11:
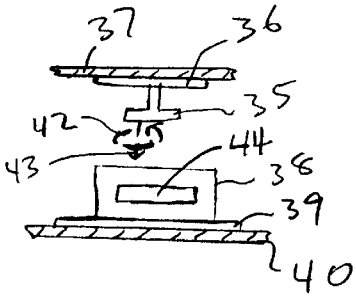
Figure 12:
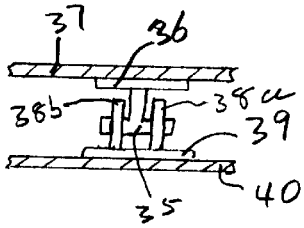

The best mode presently contemplated for carrying out the invention is illustrated in the accompany drawings, in which:

FIG. 1 is a front right side perspective view of the inflatable play structure of the invention;

FIG. 2, a rear left side perspective view of the inflatable play structure of the invention;

FIG. 3 a top plan view of the structure of FIGS. 1 and 2;

FIG. 4, a bottom plan view;

FIG. 5, a side elevation of the structure showing the positioning of the slide to provide a standing area on the platform behind the slide;

FIG. 6, a side elevation of the opposite side to that of FIG. 5;

FIG. 7, a front elevation of the structure;

FIG. 8, a rear elevation of the structure;

FIG. 9, a front right side perspective view similar to that of FIG. 1, but showing an alternate positioning of the slide with respect to the platform to provide a landing area on the platform in front of the slide;

FIG. 10, a side elevation of the structure of FIG. 9;

FIG. 11, a side elevation of a clip means for securing the slide to the platform showing the two disconnected; and FIG. 12, a side elevation of the clip of FIG. 11 showing the clip secured together.

DETAILED DESCRIPTION OF THE ILLUSTRATED EMBODIMENTS

The inflatable play structure of the invention includes an inflatable platform 10 having a top surface 11 and an inflatable slide 12 having a bottom surface 13 with the bottom surface 13 of the slide 12 mounted on the top surface 11 of the platform 10. Slide 12 is secured to platform 10 by clips 14, such as releasable clips which allow separation of the slide and platform by a user, or other suitable securement means. Slide 12 includes a substantially vertical wall or end 15 with a sloped slide surface 16 extending from the top of the substantially vertical end 15 downwardly toward the opposite end 17 to form a slide surface upon which a user can slide from the upper end at the top of end 15 downwardly to and off the opposite end of the sloped slide surface 16. End 17 may extend upwardly from slide bottom surface 13 a short distance (shorter distance than end 15), as shown, or may be substantially flush with the edge of bottom surface 13. Inflatable sides 20 may be provided extending along the sides of sloped slide surface 16 to ensure that a user does not slide off a side of the surface.

The play structure of the invention may be used in water or on land. When the structure is used in water, it is preferred that the slide 12 be positioned on the platform 10 as shown in FIGS. 1, 2, 3, 5, and 6, to provide platform space 21 between end 22 of platform 10 and end 15 of slide 12. Preferable there is about two feet of platform extending behind end 15 of slide 12 to provide room for users to stand and prepare for use of the slide. Handles 25 are secured to platform 10, such as on top surface 11, to help a user mount the platform from the water. Handles 26, and foot receiving grip holes 27 if desired, may be provided to help a user get onto the sloped slide surface. Foot holds 27 may be formed by baffles extending through the slide. The end 17 of the slide is positioned in close proximity to the edge 28 of the platform, allowing the user to have an unobstructed free fall from the end of the slide surface into the water. This configuration is also used when the structure is placed on land directly adjacent a body of water such as at the edge of a swimming pool or at the edge of a dock so that the user slides off the sloped surface of the slide and falls into the water.

When the structure is used on land away from water, either outdoors, such as on grass, or inside, such as in a room, it is preferred that the slide 12 be positioned on the platform 10 as shown in FIGS. 9 and 10 to provide platform space 31 between the end 28 of platform 10 and end 17 of slide 12 so that there is an adequate length of platform space extending beyond the end of the slide end 17 to allow the user to have a soft landing on the inflatable platform 10 as he or she slides off the sloped surface of the slide. Slide 10 can be positioned so that a small step is formed between platform end 22 and slide end 15.

To facilitate movement of the slide 12 in respect to platform 10, the securing clips 14 can be arranged in a grid formation with extra clips so that the slide can be secured in either position described above by selecting the appropriate clips 14 to use. A set of clips 14 will be unused on the platform area providing the platform space such as platform space 21 in FIGS. 1 and 2. Alternately, the arrangement of clips would allow the user to rotate the slide 12 one hundred and eighty degrees with respect to the platform 10 to effectively move the slide forward or backward on the platform.

While various clips could be used for clips 14, or various means other than clips could be used to secure slide 12 to platform 10 (slide 12 could even be permanently attached to platform 10 in one or the other water or land configurations), a clip as shown in FIGS. 11 and 12 is commercially available and has been found satisfactory. As shown in FIGS. 11 and 12, a "T" fitting 35 extending from a securement disc 36 is secured to the material 37 forming slide 12. Disc 36 may be glued, heat sealed, or ultrasonically welded to such material. Similarly, a receiving bracket 38 made up of two plates 38*a* and 38*b* extending from securement disc 39 is secured to material 40 forming platform 10. To secure the clips together, "T" fitting 35 is rotated as shown by arrow 42 so the "T" is aligned with the space between plates 38*a* and 38*b* and is moved downwardly between the plates. Because the material forming slide 12 is flexible, a user can rotate "T" fitting 35 as indicated, although some deflation of slide 12 may be necessary. When "T" fitting 35 is positioned between plates 38*a* and 38*b*, it is allowed to rotate back to is normal position which causes the arms of the "T" to move into slots 44 in plates 38*a* and 38*b* to hold the two together. The operation is reversed to release the clips.

In a preferred embodiment of the invention, the inflatable mat or platform 10 is approximately ten inches thick, by six feet wide, by nine feet long. Platform 10 holds its rectangular shape by means of a plurality of internal baffles well known in the art. The platform is made of flexible material known for use in inflatable structures. It may have carrying handles on the sides (not shown), if desired, for use while the mat is inflated, and, as indicated, handles or grips 25 at the top of one end to allow swimmers to get a grip to help them mount the mat from the water. The mat could be much bigger, or smaller, depending on its end use and the size of the slide.

In such preferred embodiment, the inflatable slide 12 may be approximately three feet high, four feet wide, and six feet long. Again, the shape of the slide is maintained by internal baffles and it is constructed of similar material as the platform. The slide can be higher, wider, and/or longer, which would enable larger people to use it. However, the platform would have to be appropriately larger also.

The invention provides a stable, inflatable platform that will allow an inflatable slide to be connected to its surface. Without the inflatable platform, the slide would be unstable in water, easily capsizing. In addition, the platform provides a standing, resting, and staging area for a user to prepare for the slide when used in water, and a cushioned landing area when used on land.

If desired, the slide can have a hose attachment at the top of the sloped surface to allow a water connection for the purpose of keeping the slide constantly wet and slippery when being used, particularly when being used on grass. For example, the hose attachment can take the form of a hose clamp 49, FIG. 9, into which the end of a garden hose may be placed, or could be a spray nozzle or other distribution device. Further, the two components, platform and slide, can be separated and used separately as a slide on the ground, although it is preferred to use the platform when the slide is used, and the platform used as a floating raft or sunbathing platform. For such use, the platform can be turned over so that the smooth bottom as shown in FIG. 4 is exposed and used and the clips 14 are not exposed. The bottom may be provided with cylindrical indentations 50 which serve as drink and cup holders for use by a user lounging on the platform. The platform can also make a tumbling or exercise mat.

While an end of the slide has been described as substantially vertical, this description means that it extends upwardly from the platform to the sloped surface at a steep angle, but can vary some from vertical as shown in the drawings.

Whereas this invention is here illustrated and described with reference to embodiments thereof presently contemplated as the best mode of carrying out such invention in actual practice, it is to be understood that various changes may be made in adapting the invention to different embodiments thereof without departing from the broader inventive concepts disclosed herein and comprehended by the claims that follow.

What is claimed is:

1. An inflatable play structure, comprising:

an inflatable platform having an upper surface;

an inflatable slide having a bottom surface to rest on the upper surface of the platform and having opposite ends, a substantially vertical surface extending upwardly from one end of the bottom surface to a top, and a sloped surface extending downwardly from the top of the substantially vertical surface toward the opposite end of the bottom surface to a lower sloped surface end, the sloped surface providing a surface over which a user can slide; and means for securing the inflatable slide to the upper surface of the inflatable platform.

2. An inflatable play structure according to claim 1, wherein the means for securing the inflatable slide to the inflatable platform positions the inflatable slide on the inflatable platform to provide room for standing on the inflatable platform adjacent the substantially vertical surface of the inflatable slide.

3. An inflatable play structure according to claim 2, wherein the means for securing the inflatable slide to the inflatable platform are clips.

4. An inflatable play structure according to claim 1, wherein the means for securing the inflatable slide to the inflatable platform positions the inflatable slide on the inflatable platform to provide a landing surface on the inflatable platform adjacent the opposite end of the bottom surface on which a user sliding down the sloped surface will land after reaching the lower end of the sloped surface.

5. An inflatable play structure according to claim 4, wherein the means for securing the inflatable slide to the inflatable platform are clips.

6. An inflatable play structure according to claim 1, wherein the means for securing the inflatable slide to the upper surface of the inflatable platform allow the slide and platform to be separated and reconnected wherein the positioning of the platform may be changed by a user.

7. An inflatable play structure according to claim 1, additionally including aids to help a user climb up the substantially vertical end of the inflatable slide.

8. An inflatable play structure according to claim 7, wherein the aids are handles secured to the substantially vertically end.

9. An inflatable play structure according to claim 8, wherein the aids also include foot holds formed in the substantially vertically end.

10. An inflatable play structure according to claim 1, wherein the sloped surface has a length and additionally including inflatable sides extending along the length of the sloped surface.

11. An inflatable play structure according to claim 1, wherein the platform is separable from the slide and has a substantially smooth bottom surface which can be used to lounge on when the platform is separated from the slide and turned so that the bottom side is facing upwardly, and additionally including indentations in the bottom surface which form cup holders.

12. An inflatable play structure according to claim 11, wherein the means for securing the inflatable slide to the inflatable platform are releasable clips.

13. An inflatable play structure according to claim 1, wherein the means for securing the inflatable slide to the inflatable platform are clips releasable clips.

14. An inflatable play structure according to claim 1, additionally including a means to apply water to the sloped surface to keep such sloped surface wet.

15. An inflatable play structure according to claim 14, wherein the means to apply water to the sloped surface is a clamp to hold a garden hose directed to apply water to the sloped surface.

* * * * *